United States Patent [19]

Sindlinger

[11] Patent Number: 4,647,893

[45] Date of Patent: Mar. 3, 1987

[54] RAPID-START FLUORESCENT LAMP HAVING A BIMETAL CIRCUIT BREAKER WITH LEG PORTIONS OF UNEQUAL LENGTH

[75] Inventor: Ronald E. Sindlinger, Muncy, Pa.

[73] Assignee: GTE Products Corporation, Stamford, Conn.

[21] Appl. No.: 779,314

[22] Filed: Sep. 24, 1985

Related U.S. Application Data

[63] Continuation of Ser. No. 520,866, Aug. 5, 1983, abandoned.

[51] Int. Cl.[4] ..... H01H 61/00

[52] U.S. Cl. ..... 337/24; 315/72; 315/73; 315/74; 315/104; 315/106; 337/25; 337/27

[58] Field of Search ..... 315/72, 73, 74, 104, 315/106; 337/24, 25, 27, 221; 313/316

[56] References Cited

U.S. PATENT DOCUMENTS

| | | | |
|---|---|---|---|
| 3,858,086 | 12/1974 | Anderson et al. | 315/74 |
| 4,001,634 | 1/1977 | Corbley et al. | 315/73 |
| 4,052,687 | 10/1977 | Kimball | 337/25 |
| 4,156,831 | 5/1979 | Cassidy et al. | 315/73 |

FOREIGN PATENT DOCUMENTS

| | | | |
|---|---|---|---|
| 510823 | 3/1955 | Canada | 337/25 |
| 531948 | 10/1956 | Canada | 337/25 |
| 1228700 | 11/1966 | Fed. Rep. of Germany | 337/25 |
| 962790 | 6/1950 | France | 337/27 |
| 484899 | 9/1953 | Italy | 315/72 |

*Primary Examiner*—Jerome Massie

*Attorney, Agent, or Firm*—Carlo S. Bessone; Thomas H. Buffton

[57] ABSTRACT

A rapid-start fluorescent lamp includes a circuit breaker having a sealed glass bottle, a pair of electrical conductors sealed therein and passing therethrough and a thermally sensitive bimetal switch within the glass bottle with the bimetal switch having a pair of leg portions of unequal length.

4 Claims, 2 Drawing Figures

RAPID-START FLUORESCENT LAMP HAVING A BIMETAL CIRCUIT BREAKER WITH LEG PORTIONS OF UNEQUAL LENGTH

This application is a continuation of application Ser. No. 520,866, filed 8/5/83, now abandoned.

CROSS REFERENCE TO OTHER APPLICATIONS

The following concurrently-filed applications relate to rapid-start fluorescent lamps and bimetal circuit breakers for fluorescent lamps: Ser. Nos. 520,865; 520,863, and 520,862 now U.S. Pat. No. 4,528,479.

TECHNICAL FIELD

This invention relates to rapid-start type fluorescent lamps and more particularly to rapid-start type fluorescent lamps having a thermally sensitive bimetal circuit breaker thereon of U-shaped configuration and uneven length portions.

BACKGROUND ART

Generally, the most commonly encountered fluorescent lamps are the so-called "preheat" and "rapid-start" types of fluorescent lamps. In the "preheat" type of lamp, heater current flows through the lamp electrode during lamp ignition. Thereafter, an external voltage sensitive starter opens the electrical circuit to the lamp electrode and heater current flow is discontinued. The "rapid-start" type of fluorescent lamp normally has a constant flow of heater current through each electrode not only during ignition but also during operation of the lamp. However, heater current flow during operation, as in the "rapid-start" lamp, is lost power which undesirably reduces the operational efficiency of the lamp.

Numerous suggestions have been made for enhancing the efficiency of "rapid-start" type fluorescent lamps. For example, U.S. Pat. Nos. 4,052,687; 4,097,779; 4,114,968; 4,156,831 and 4,171,519 which are all assigned to the Assignee of the present application, provide numerous configurations for enhanced operation of "rapid-start" type fluorescent lamps. Primarily, each provides a thermally responsive circuit breaker suitable for discontinuing heater current during operation of the fluorescent lamp.

Although the above-described fluorescent lamp and circuit breaker structures have numerous advantages, it has been found that there are problems with the known configurations. More specifically, the known rapid start fluorescent lamps utilizing a circuit breaker therein normally employ a circuit breaker of the type having a substantially U-shaped bimetal switch. This U-shaped thermally responsive bimetal switch includes a pair of leg portions of substantially uniform length. One of the leg portions is welded to an electrical conductor passing through the glass envelope of the circuit breaker and the other leg portion makes contact with another electrical conductor passing through the glass envelope.

While the above-described circuit breakers having a U-shaped bimetal switch with a pair of leg portions of equal length have been an improvement over other known structures, it has been found that the leg portion which is attached to one of the electrical conductors tends to bend, upon the application of heat thereto, prior to the bimetal moving away from the other electrical conductor whereat a switching contact is present. As a result of this undesired bending of the bimetal, it was determined that the opening temperatures of the bimetal switch vary by several degrees centigrade depending upon the amount of flexure occurring along the leg portion fastened to the electrical conductor. Moreover, this undesired bending of the leg portion of the U-shaped bimetal caused a shift in the location at which the opposite leg portion contacted the other electrical conductor. This variation in contact point was also detrimental to a uniform operation of the switch at a given temperature.

OBJECTS AND SUMMARY OF THE INVENTION

An object of the present invention is to provide an enhanced rapid-start fluorescent lamp. Another object of the invention is to improve the operation of a circuit breaker suitable for use in a rapid-start fluorescent lamp. A further object of the present invention is to improve the consistency and repeatability of the switching operation of a circuit breaker usable in a rapid-start fluorescent lamp.

These and other objects, advantages and capabilities are achieved in one aspect of the invention by a rapid-start fluorescent lamp having a circuit breaker therein with a thermally sensitive bimetal switch having a substantially U-shaped configuration and a pair of leg portions of different lengths.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
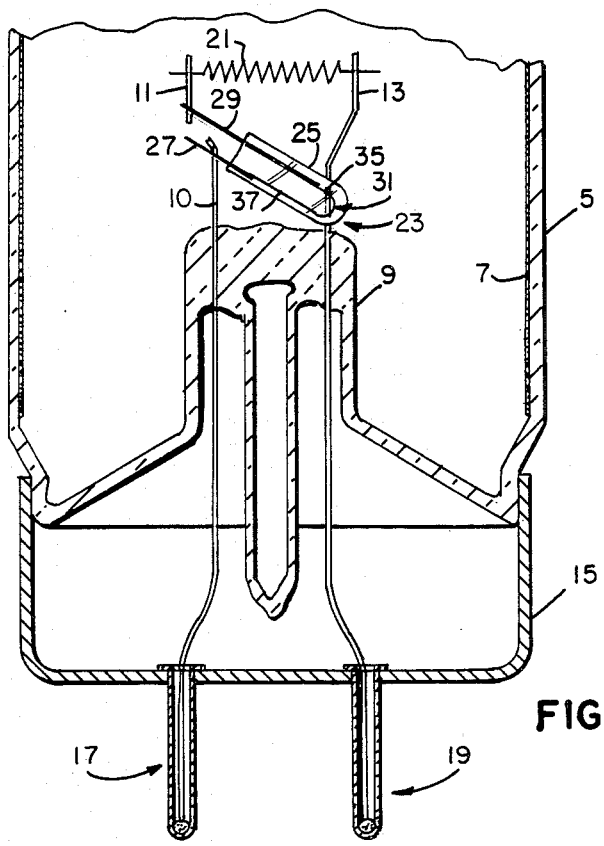
FIG. 1 is an elevational view, partly in section, on one end of a rapid-start fluorescent lamp having a circuit breaker therein.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 10 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external source (not shown). Moreover, the envelope 5 has a gas fill therein selected from the group consisting of argon, krypton, neon, helium and combinations thereof.

An electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this electrode 21, which is frequently referred to as a filament or cathode, is of well known type used in rapid start fluorescent lamps and usually includes a tungsten coil having a coating thereon in the form of alkaline earth oxides which were applied in the form of carbonates and processed to provide the oxides.

Disposed within the envelope 5 is a circuit breaker 23. The circuit breaker 23 is preferably in the form of a glass bottle 25 having a press seal at one end thereof. A first electrical conductor 29 and a second electrical conductor 27 are sealed into and pass through the press seal of the glass bottle 25. The inwardly extending portion (i.e., located within the glass bottle 25) of the first electrical conductor 29 has a greater than the inwardly extending portion of the second conductor 27. Also, a thermally-sensitive bimetal 31 is positioned within the glass bottle 25 with one end thereof attached to one of the electrical conductors 27 and the opposite end of the bitmetal 31 contacting the other electrical conductor 29. Further, a conductive by-pass element 33, which is meltable in response to a short-duration high voltage pulse potential, shunts the bitmetal 31 and is electrically connected to the electrical conductors 27 and 29. Moreover, the electrical conductors 27 and 29 extending outwardly of the glass bottle 25 are connected to the pass pin 17 by way of electrical lead 10 and to the electrical lead 11 respectively with the electrical lead 11 also connected to one end of the electrode 21.

Figure 2:
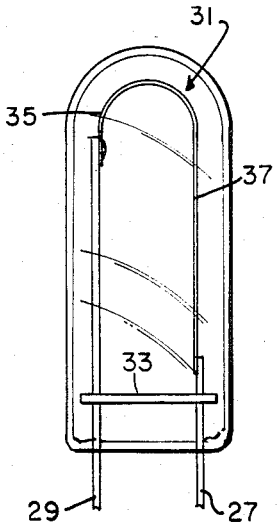
FIG. 2 is a cross-sectional view of the circuit breaker of FIG. 1 illustrating the configuration of the invention.

Referring to the enlarged illustration of the circuit breaker (FIG. 2), it can readily be seen that the bimetal 31 is of a substantially U-shaped configuration having a first leg portion 35 which is attached inwardly extending portion of the first electrical conductor 29. A second leg portion 37 is in contact with the inwardly extending portion of the second electrical conductor 27. As can readily be seen, the first and second leg portions 35 and 37 are of unequal length. Also, the first leg portion 35 which is affixed to the first electrical conductor 29, as by welding for instance, is not as great in length as the second leg portion 37 which contacts the first electrical conductor 27.

Additionally, it can readily be seen that a shorter first leg portion 35 tends to virtually eliminate any flexure along the length thereof. Also, the reduced length of the first leg portion 35 permits a shortening of the contact area of the second leg portion 37 and second electrical conductor 27 since the effective length of the bimetal 35 and consequently, the amount of change of length due to heating, has been reduced. Moreover, the total length of bimetal material has been reduced which also reduces the amount and cost of bimetal material. As a result of this reduction in bimetal material, reduction in flexure of the bimetal by reduction of the length of the first leg portion and reduced amount of movement between bimetal leg portion 37 and electrical conductor 27, uniformity and consistency of operating temperature of the bimetal switch 35 has been improved.

While there has been shown and described what is at present considered the preferred embodiments of the invention, it will be obvious to those skilled in the art that various modifications and changes may be made therein without departing from the invention as defined by the appended claims.

What is claimed is:

1. A circuit breaker for use in a rapid-start fluorescent lamp comprising:

a sealed glass bottle;

first and second electrical conductors sealed into and passing through said glass bottle, the inwardly extending portion of said first electrical conductor having a length greater than the inwardly extending portion of said second conductor;

a meltable by-pass element disposed within said glass bottle short-circuiting said pair of electrical conductors; and a thermally sensitive bimetal switch within said glass bottle shunting said by-pass element, said bimetal switch having first and second leg portions with said first leg portion attached to said first electrical conductor, said second leg portion contacting said second electrical conductor and said first leg portion being of a length less than the length of said second leg portion of said bimetal switch.

2. The circuit breaker of claim 1 wherein said first leg portion of said bimetal switch is welded to said first electrical conductor.

3. A rapid-start fluorescent lamp comprising a glass envelope having a phosphor-coated inner wall surface, a pair of spaced electrodes within said envelope, a pair of electrically conductive leads sealed into and passing through said envelope for connecting said electrode to an energized source and a circuit breaker disposed within said envelope, said circuit breaker having a sealed glass envelope, first and second electrical conductors sealed therein and passing therethrough with the outwardly extending portions of said electrical conductors connected to an electrode and to one of said pair of electrically conductive leads, the inwardly extending portion of said first electrical conductor having a length greater than the inwardly extending portion of said second electrical conductor and a thermally sensitive bimetal switch within said glass bottle formed into a U-shaped configuration having first and second leg portions with said first leg portion attached to said first electrical conductor and said second leg portion contacting said second electrical conductor, said first leg portion being of a length less than the length of said second leg portion.

4. The rapid-start fluorescent lamp of claim 3 wherein said first leg portion of said bimetal switch is welded to said first electrical conductors.

* * * * *